US007437820B2

(12) United States Patent
Sexton et al.

(10) Patent No.: US 7,437,820 B2
(45) Date of Patent: Oct. 21, 2008

(54) METHOD OF MANUFACTURING A CHARGE PLATE AND ORIFICE PLATE FOR CONTINUOUS INK JET PRINTERS

(75) Inventors: Richard W. Sexton, Bainbridge, OH (US); Shan Guan, Dublin, OH (US); Michael F. Baumer, Dayton, OH (US); James E. Harrison, Jr., Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 175 days.

(21) Appl. No.: 11/382,773

(22) Filed: May 11, 2006

(65) Prior Publication Data

US 2007/0261240 A1 Nov. 15, 2007

(51) Int. Cl.
*B21D 53/76* (2006.01)
*B41J 2/16* (2006.01)

(52) U.S. Cl. ..... 29/890.1; 29/852; 216/27; 216/39; 347/20; 347/44; 347/47

(58) Field of Classification Search ..... 29/890.1, 29/611, 23.35, 852; 347/47, 20, 44, 48; 216/27, 216/39, 42; 438/21, 38
See application file for complete search history.

(56) References Cited

U.S. PATENT DOCUMENTS

| | | | |
|---|---|---|---|
| 3,984,843 | A | 10/1976 | Kuhn |
| 4,047,184 | A | 9/1977 | Bassous et al. |
| 4,106,975 | A | 8/1978 | Berkenblit et al. |
| 4,184,925 | A | 1/1980 | Kenworthy |
| 4,213,238 | A | 7/1980 | Gudorf |
| 4,223,320 | A | 9/1980 | Paranjpe et al. |
| 4,271,589 | A | 6/1981 | Gudorf |
| 4,277,548 | A | 7/1981 | Vedder |
| 4,334,232 | A | 6/1982 | Head |
| 4,347,522 | A | 8/1982 | Bahl et al. |

(Continued)

FOREIGN PATENT DOCUMENTS

| | | |
|---|---|---|
| EP | 0 938 079 | 8/1999 |

(Continued)

OTHER PUBLICATIONS

T. Diepold et al., A Micromachined Continuous Ink Jet Print Head for High-Resolution Printing, J. Micromech. Microeng. 8, 1998, pp. 144-147.

(Continued)

*Primary Examiner*—A. Dexter Tugbang
(74) *Attorney, Agent, or Firm*—William R. Zimmerli

(57) ABSTRACT

A charge plate is fabricated for a continuous ink jet printer print head by applying an etch-stop to one of the opposed sides of an electrically non-conductive substrate. An array of charging channels are etched into the substrate through the etch-stop layer adjacent to predetermined orifice positions. The charging channels are passivated by depositing a dielectric insulator into the charging channels; and electrical leads are formed by coating the passivated charging channels with metal. A second etch-stop layer is applied to the other of the opposed sides of the substrate, and an array of orifices is formed through the orifice plate substrate at the predetermined orifice positions. The orifices extend between the opposed sides.

10 Claims, 9 Drawing Sheets

U.S. PATENT DOCUMENTS

| | | | | |
|---|---|---|---|---|
| 4,373,707 | A | 2/1983 | Molders | |
| 4,374,707 | A | 2/1983 | Pollack | |
| 4,378,631 | A | 4/1983 | Head et al. | |
| 4,560,991 | A | 12/1985 | Schutrum | |
| 4,636,808 | A | 1/1987 | Herron | |
| 4,678,680 | A | 7/1987 | Abowitz | |
| 4,894,664 | A | 1/1990 | Pan | |
| 4,928,113 | A | 5/1990 | Howell et al. | |
| 4,972,201 | A | 11/1990 | Katerberg et al. | |
| 4,972,204 | A | 11/1990 | Sexton | |
| 4,999,647 | A | 3/1991 | Wood et al. | |
| 5,455,611 | A | 10/1995 | Simon et al. | |
| 5,475,409 | A | 12/1995 | Simon et al. | |
| 5,512,117 | A | 4/1996 | Morris | |
| 5,559,539 | A | 9/1996 | Vo et al. | |
| 5,604,521 | A | 2/1997 | Merket et al. | |
| 5,820,770 | A | 10/1998 | Cohen et al. | |
| 6,164,759 | A | 12/2000 | Fujii et al. | |
| 6,375,310 | B1 | 4/2002 | Arakawa et al. | |
| 6,431,682 | B1 | 8/2002 | Osada et al. | |
| 6,443,562 | B1 * | 9/2002 | Yoon | 347/63 |
| 6,464,892 | B2 | 10/2002 | Moon et al. | |
| 6,475,402 | B2 * | 11/2002 | Nordstrom et al. | 216/27 |
| 6,545,406 | B2 | 4/2003 | Hofmann et al. | |
| 6,560,991 | B1 | 5/2003 | Kotliar | |
| 6,568,794 | B2 * | 5/2003 | Yamanaka et al. | 347/54 |
| 6,594,898 | B1 * | 7/2003 | Yun | 29/890.1 |
| 6,627,096 | B2 | 9/2003 | Sherrer et al. | |
| 6,635,184 | B1 | 10/2003 | Cohen et al. | |
| 6,660,614 | B2 | 12/2003 | Hirschfeld et al. | |
| 6,757,973 | B2 * | 7/2004 | Park | 29/890.1 |
| 6,759,309 | B2 | 7/2004 | Gross | |
| 6,767,473 | B2 * | 7/2004 | Fujita et al. | 216/27 |
| 6,780,339 | B2 * | 8/2004 | Anagnostopoulos et al. | 216/27 |
| 2001/0019897 | A1 * | 9/2001 | Kumar et al. | 438/724 |
| 2002/0000516 | A1 | 1/2002 | Schultz et al. | |
| 2002/0000517 | A1 | 1/2002 | Corso et al. | |
| 2002/0063107 | A1 | 5/2002 | Moon et al. | |
| 2002/0089573 | A1 * | 7/2002 | Yun | 347/68 |
| 2003/0022397 | A1 | 1/2003 | Hess et al. | |
| 2003/0054645 | A1 | 3/2003 | Sheldon | |
| 2003/0066816 | A1 | 4/2003 | Schultz et al. | |
| 2003/0073260 | A1 | 4/2003 | Corso | |
| 2003/0159287 | A1 * | 8/2003 | Imamura et al. | 29/890.1 |
| 2003/0167637 | A1 * | 9/2003 | Maeda et al. | 29/890.1 |
| 2005/0225238 | A1 * | 10/2005 | Yamazaki | 313/506 |
| 2005/0280674 | A1 * | 12/2005 | McReynolds | 347/65 |
| 2006/0037936 | A1 * | 2/2006 | Kim et al. | 216/27 |

FOREIGN PATENT DOCUMENTS

| | | | |
|---|---|---|---|
| EP | 1 020 291 | 1/2000 | |
| FR | 2 698 584 | 11/1992 | |
| JP | 05024204 A * | 2/1993 | 29/890.1 |

OTHER PUBLICATIONS

J. Smith et al., Continuous Ink-Jet Print Head Utilizing Silicon Micromachined Nozzles, Sensors and Actuators A, 43, 1994, pp. 311-316.

Rhonda Renee Myers, Novel Devices for Continuous-on-Demand Ink jet Deflection Technologies, B.S.E.E., University of Cincinnati, Nov. 17, 2005.

* cited by examiner

METHOD OF MANUFACTURING A CHARGE PLATE AND ORIFICE PLATE FOR CONTINUOUS INK JET PRINTERS

CROSS REFERENCE TO RELATED APPLICATIONS

Reference is made to commonly assigned, U.S. patent applications Ser. No. 11/382,787 entitled SELF-ALIGNED PRINT HEAD AND ITS FABRICATION to Richard W. Sexton et al., Ser. No. 11/382,759 entitled INTEGRATED CHARGE AND ORIFICE PLATES FOR CONTINUOUS INK JET PRINTERS to Shan Guan et al. and Ser. No. 11/382,726 entitled ELECTROFORMED INTEGRAL CHARGE PLATE AND ORIFICE PLATE FOR CONTINUOUS INK JET PRINTERS to Shan Guan et al. filed concurrently herewith. filed concurrently herewith.

FIELD OF THE INVENTION

The present invention relates to continuous ink jet printers, and more specifically to the fabrication of a charge plate and its integration with a silicon orifice plate for such.

BACKGROUND OF THE INVENTION

Continuous-type ink jet printing systems create printed matter by selective charging, deflecting, and catching drops produced by one or more rows of continuously flowing ink jets. The jets themselves are produced by forcing ink under pressure through an array of orifices in an orifice plate. The jets are stimulated to break up into a stream of uniformly sized and regularly spaced droplets.

The approach for printing with these droplet streams is to use a charge plate to selectively charge certain drops and to then deflect the charged drops from their normal trajectories. The charge plate has a series of charging electrodes located equidistantly along one or more straight lines. Electrical leads are connected to each such charge electrode, and the electrical leads in turn are activated selectively by an appropriate data processing system.

Conventional and well-known processes for making the orifice plate and charge plate separately consist of photolithography and nickel electroforming. Orifice plate fabrication methods are disclosed in U.S. Pat. Nos. 4,374,707; 4,678,680; and 4,184,925. Orifice plate fabrication generally involves the deposition of nonconductive thin disks onto a conductive metal substrate using photolithographic processes. Nickel is this electroformed onto the conductive metal mandrel and partial covers the nonconductive thin metal disks to form orifices. After this electroforming process, the metal substrate is selectively etched away leaving the orifice plate electroform as a single component. Charge plate electroforming is described in U.S. Pat. Nos. 4,560,991 and 5,512,117. These charge plates are made by depositing nonconductive traces on a metal substrate followed by deposition of nickel in a similar fashion to orifice plate fabrication, except that parallel lines of metal are formed instead of orifices. Nickel, which is a ferromagnetic material, is unsuitable for use with magnetic inks. Nor can low pH ink (pH of approximately 6 or less) be used with nickel, which is etched by low pH ink. As a result, nickel materials are very suited to alkaline based fluids. U.S. Pat. No. 4,347,522 discloses the use electroforming or electroplating techniques to make a metal charge plate.

An ink jet printhead having an orifice plate and a charge plate requires precise alignment of these components to function properly. For high resolution ink jet printheads this alignment process is a difficult labor intensive operation that also requires significant tooling to achieve. It is desirable to develop a printhead that would simplify the alignment of the charging electrodes and the orifices from which ink is jetted.

Accordingly, it is an object of the present invention to provide a fabrication process of the orifice plate and charge plate that permits the use of both low pH and magnetic inks. It is another object of the present invention to provide such an orifice plate and charge plate as one, self-aligned component with high yield and robust connection.

SUMMARY OF THE INVENTION

According to a feature of the present invention, a charge plate is fabricated for a continuous ink jet printer print head by applying an etch-stop to one of the opposed sides of an electrically non-conductive substrate. An array of charging channels is etched into the substrate through the etch-stop adjacent to the predetermined orifice positions. The charging channels are passivated by depositing a dielectric insulator into the charging channels; and electrical leads are formed by coating the passivated charging channels with metal.

According to another feature of the present invention, a second etch-stop layer is applied to the other of the opposed sides of the substrate; and an array of orifices is formed through the orifice plate substrate at the predetermined orifice positions. The orifices extend between the opposed sides.

In a preferred embodiment of the present invention, the opposed sides of the orifice plate substrate are initially coated with a silicon nitride layer and the orifices are formed by etching into the orifice plate substrate through openings in the silicon nitride layer on said one of the first and second opposed sides. An ink channel is formed on the second of the opposed sides of the substrate by coating the second opposed sides of the substrate with a silicon nitride layer and etching into the orifice plate substrate through an opening in the silicon nitride layer on the second side of the orifice plate substrate.

The ink channel may be formed by deep reactive ion etching. The step of applying an etch-stop to the opposed sides of the substrate may be effected by sputtering. The charge electrodes may be placed alternatively on the two sides of the nozzle array.

DETAILED DESCRIPTION OF THE INVENTION

It will be understood that the integral orifice array plate and charge plate of the present invention is intended to cooperate with otherwise conventional components of ink jet printers that function to produce desired streams of uniformly sized and spaced drops in a highly synchronous condition. Other continuous ink jet printer components, e.g. drop ejection devices, deflection electrodes, drop catcher, media feed system, and data input and machine control electronics (not shown) cooperate to effect continuous ink jet printing. Such devices may be constructed to provide synchronous drop streams in a long array printer, and comprise in general a resonator/manifold body to which the orifice plate is attached, a plurality of piezoelectric transducer strips, and transducer energizing circuitry.

Figure 1:
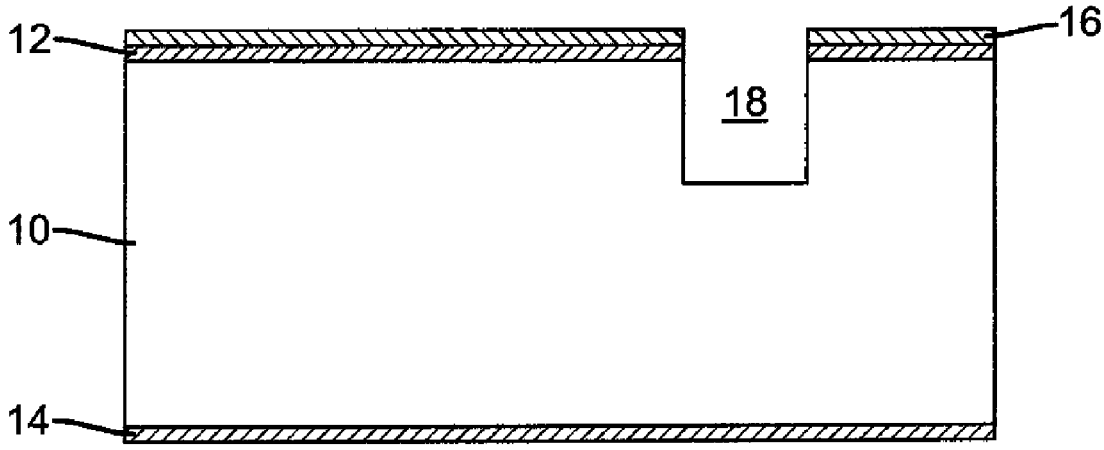
FIG. 1 is a cross-sectional view of a silicon substrate, silicon nitride layer, and patterned photo resist layer usable in the present invention.

FIG. 1 shows a silicon substrate 10 coated on both sides with thin layers 12 and 14 of silicon nitride. The layers may, for example, be 1000-2000 Å of silicon nitride or 5000 Å-10000 Å of low stress silicon nitride. In the preferred embodiment, the silicon substrate is dipped into buffered hydrofluoric acid, which chemically cleans the substrate, prior to application of the silicon nitride layers by a method such as low-pressure chemical vapor deposition. The silicon nitride will serve as an insulation layer, as explained below. A photoresist 16 has is then applied, such as by spin coating, to one side of the composite 10, 12, and 14. The photoresist has been imagewise exposed to UV radiation through a mask (not shown) and developed to leave a pattern for forming charging channels 18 as explained below. Photoresist is removed from the areas which are to become the charging electrodes and leads. Positive tone photoresist is preferred. Of course in a true cross-sectional view, the layers at the rear of the charging channel would be seen as straight lines across the top of the channel, but they have been omitted from this and subsequent figures so that the channel can be more easily seen.

Figure 2:
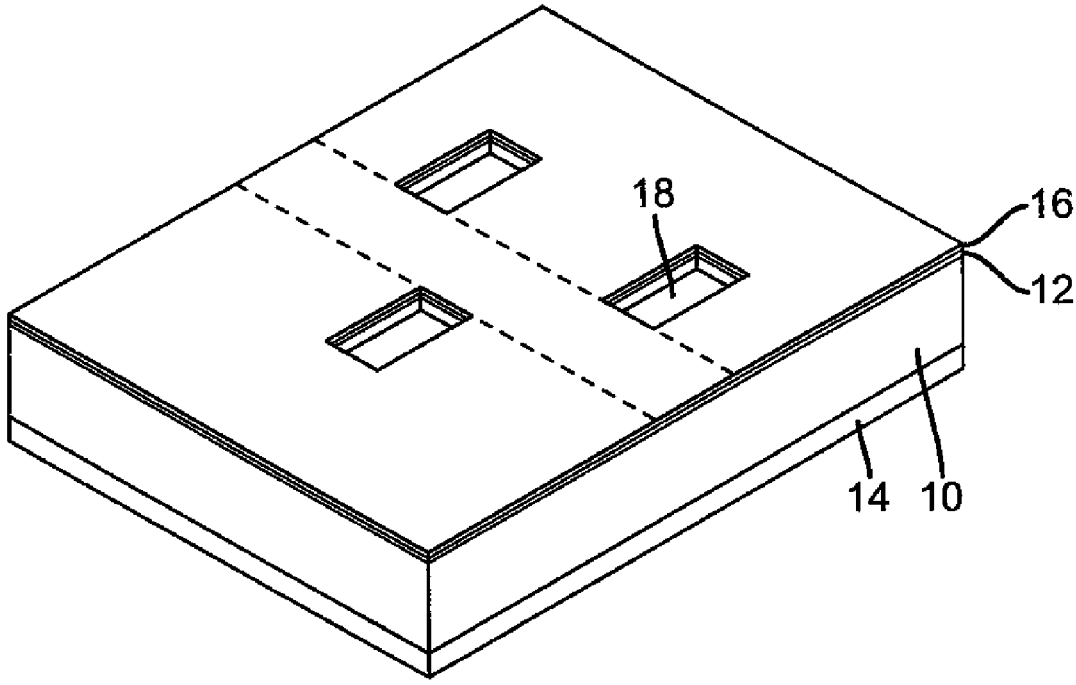
FIG. 2 is a perspective view of the orifice plate at this point in the fabrication process.
Figure 3:
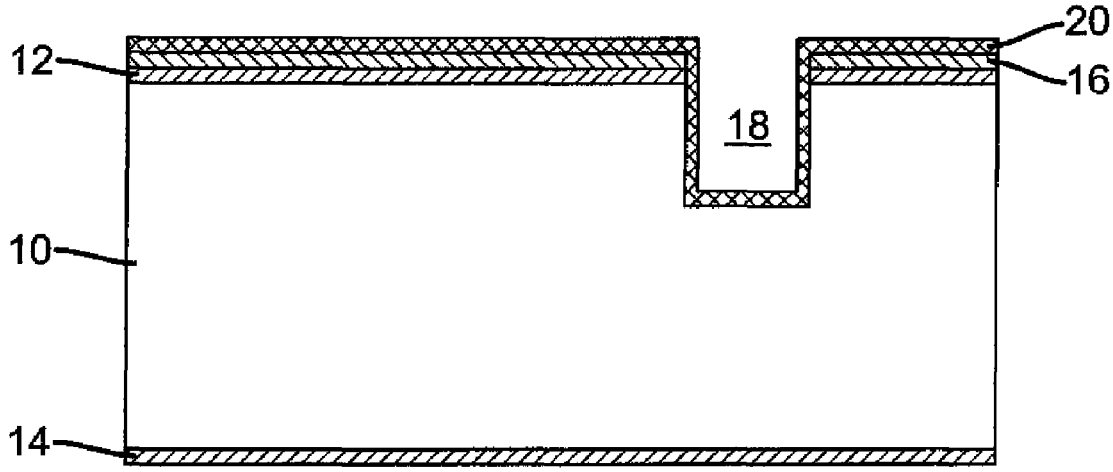
FIGS. 3-9 are cross-sectional views of the initial steps in a process for fabricating an integrated orifice plate and charge plate according to the present invention.

Looking ahead to FIG. 2, there is a plurality of charging channels 18 (one per nozzle) and the channels are preferably staggered along the length of silicon substrate 10. Of course, there are many more charging channels than shown in FIG. 2, which is simplified for diagramming purposes. Charging channels 18 are etched into silicon substrate 10 in those regions not covered by the photoresist by means such as deep reactive ion etching. A preferred channel has a depth to width ratio of 5:1. The side wall and the bottom of the charging channels 18 are passivated using PECVD (plasma enhanced chemical vapor deposition) of silicon nitride ($Si_3N_4$) or, preferably, silicon oxide. This is illustrated by a passivation layer 20 in FIG. 3. A preferred silicon nitride or silicon oxide thickness is 0.5 to 0.8 um. This passivation layer also covers the photoresist 16 as well.

Figure 4:
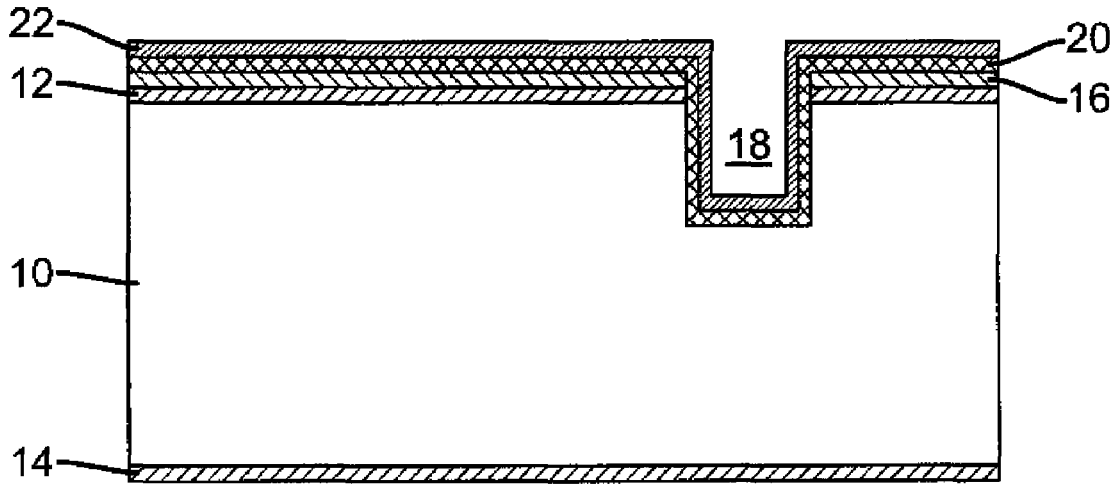
Figure 5:
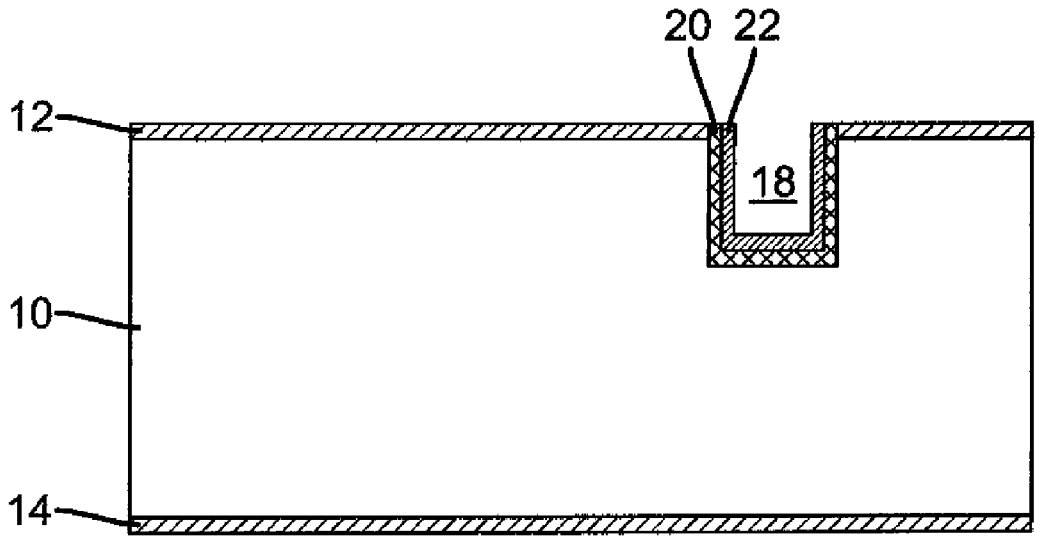

In FIG. 4, passivation layer 20, both in the charging channels and on top of the photoresist has been metallized with a metal layer 22 of gold, copper or nickel on top of an adhesion layer of chromium or titanium. A preferred metallization technique is sputtering, which has good coating step coverage. A preferred metal film thickness is 0.2 μm to 0.4 μm. When the assemblage is immersed in a solvent solution such as, for example, acetone, those portions of the metal layer 22 and the oxide passivation layer 20 that have been deposited onto the photoresist will lift off the wafer as the photoresist dissolves. The metal layer 22 applied to the bottom and side walls of the charging channels remains in place, forming the drop charging electrodes and leads. Next, an $O_2$ plasma is used to clean the wafer surface, producing the intermediate illustrated in FIG. 5.

Figure 6:
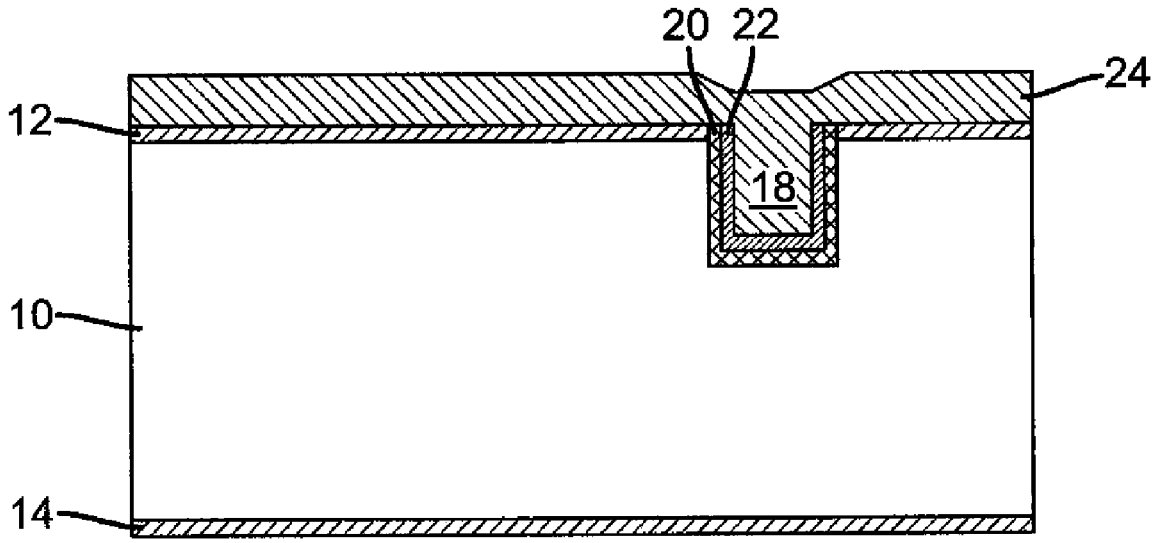
Figure 7:
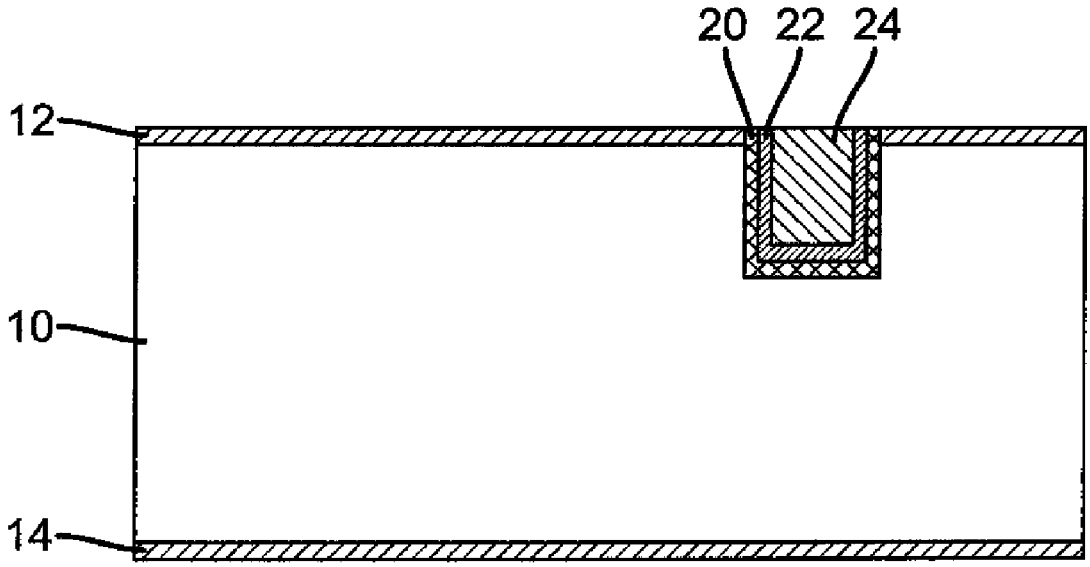

The charging channel 18 is filled with sacrificial material 24, as shown in FIG. 6. The sacrificial material may be SU-8 or AZ 100nXT, both well known to persons skilled in the art. The material is lightly baked and planarized using chemical mechanical polishing to produce the intermediate shown in FIG. 7.

Figure 8:
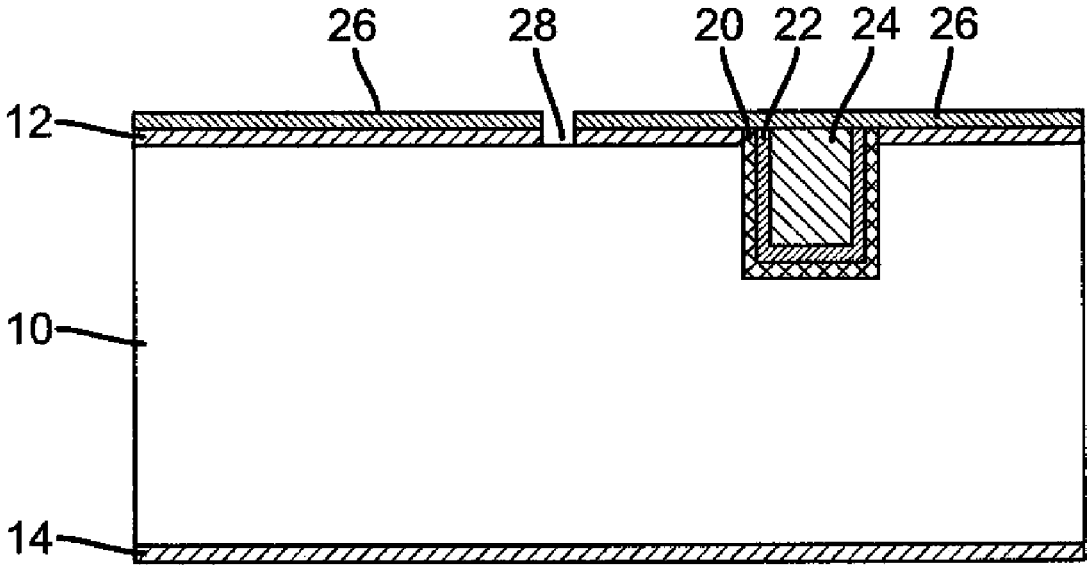
Figure 9:
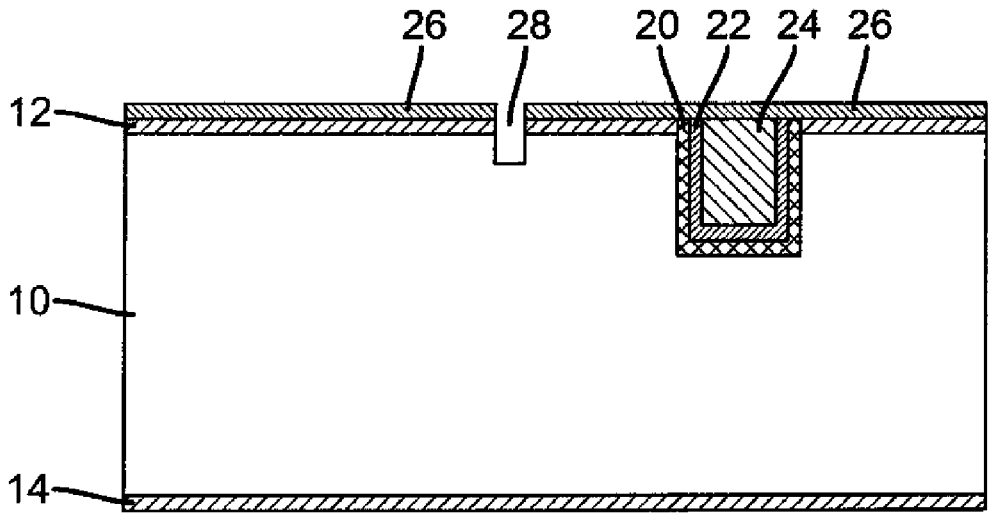
Figure 10:
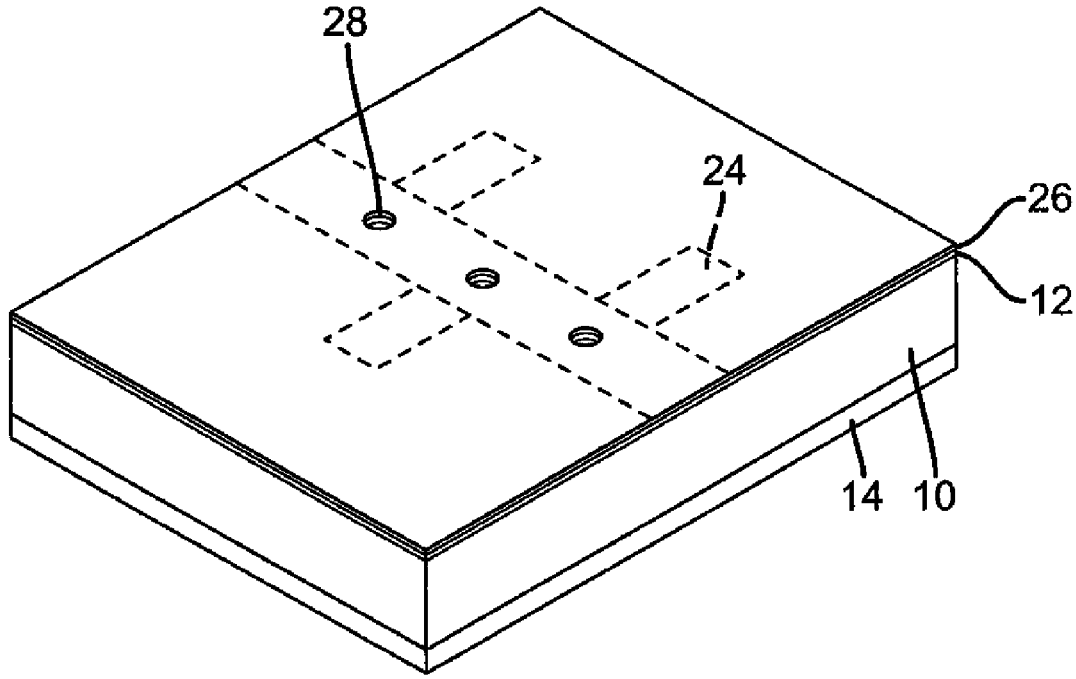
FIG. 10 is a perspective view of the orifice plate at the completion of FIG. 9 in the fabrication process.

A layer 26 of a positive photoresist is spun onto the wafer. Another photolithography step patterns the photoresist 26, as illustrated in FIG. 8, so as to define an array of predetermined spaced-apart orifice positions;

Referring to FIG. 9, a nozzle opening hole 28 is etched into the silicon substrate 10 using deep reactive ion etching. Deep reactive ion etching is a special form of reactive ion etching that provides a deep etched profile with relatively straight sidewalls. The etching depth, illustrated in FIG. 9, is controlled by the duration of the etch process. FIG. 10 illustrates the process at this juncture of the fabrication procedure.

Figure 11:
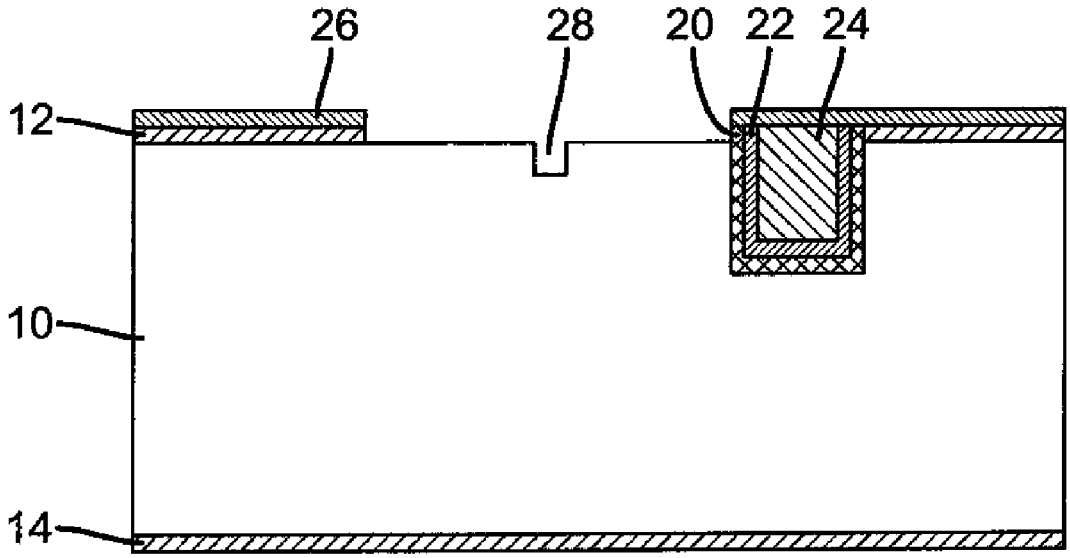
FIGS. 11 and 12 are cross-sectional views of steps in a process for fabricating an integrated orifice plate and charge plate according to the present invention.
Figure 12:
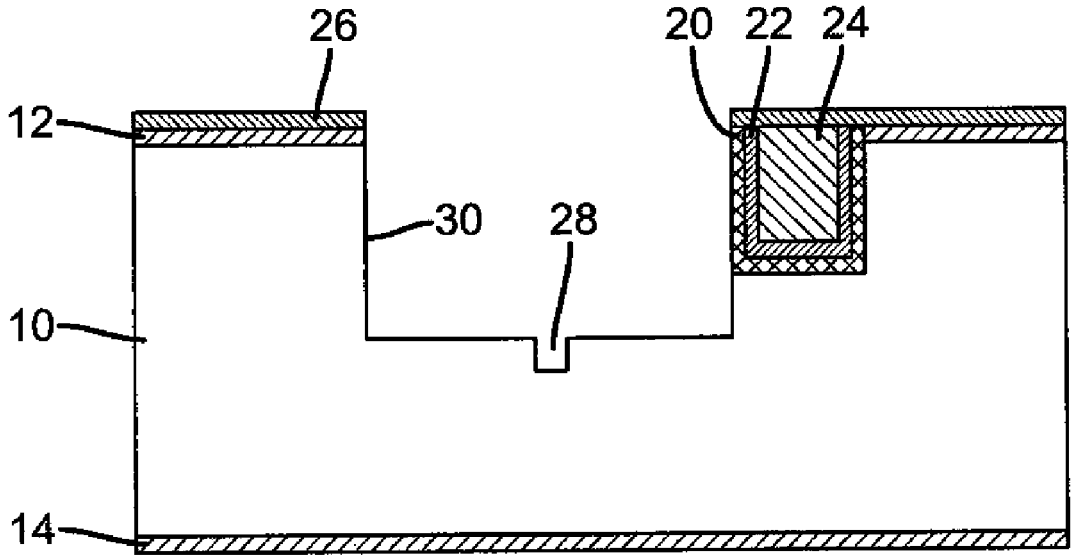
Figure 13:
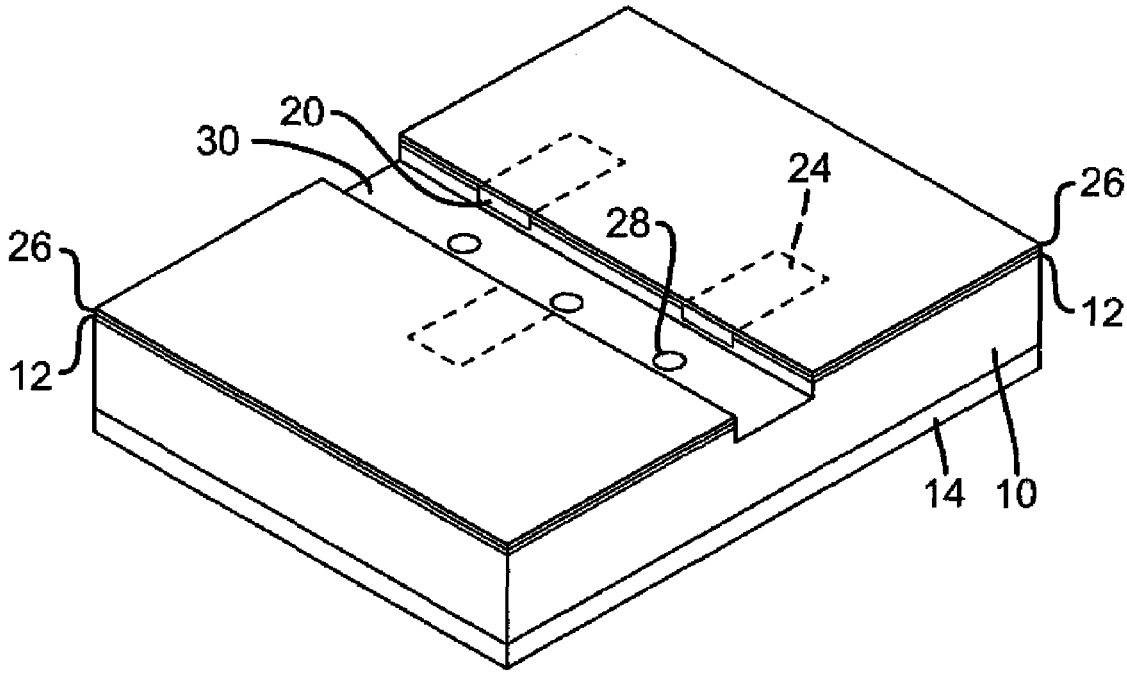
FIG. 13 is a perspective view of the orifice plate at the completion of FIG. 12 in the fabrication process.

The photoresist layer 26 is repatterned to expose additional portions of the silicon nitride layer 12. The newly exposed silicon nitride layer is removed as illustrated in FIG. 11. Referring to FIG. 12, nozzle opening hole 28 and a trench 30 are simultaneously deep reactive ion etched. Again, the etching depth is controlled by the duration of the etch process. FIG. 13 illustrates the process at this point of the fabrication procedure.

Figure 14:
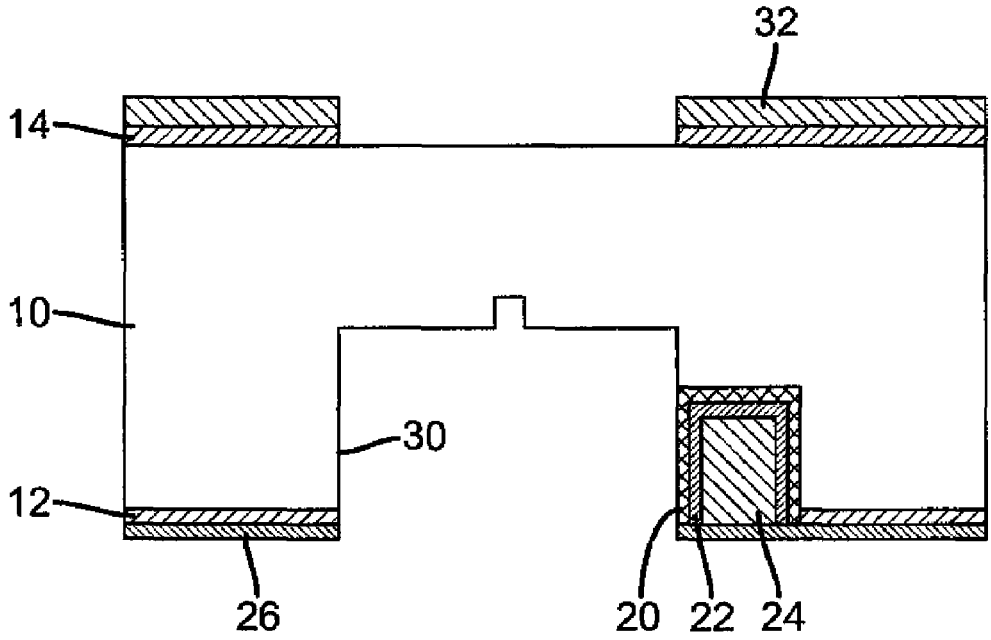
FIGS. 14 and 15 are cross-sectional views of steps in a process for fabricating an integrated orifice plate and charge plate according to the present invention.
Figure 15:
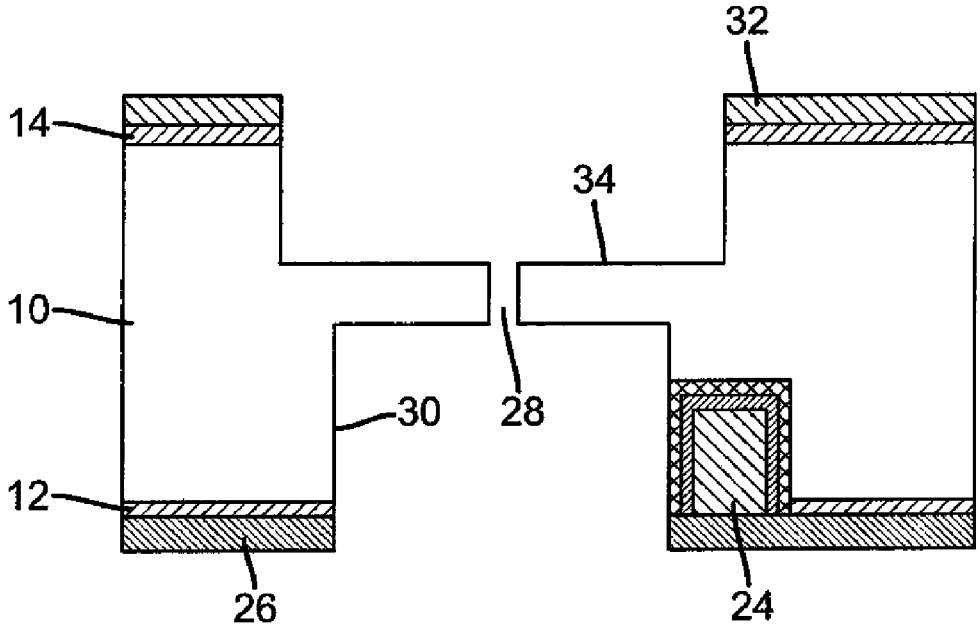

Having completed the fabrication steps on the first side of the substrate, a photoresist layer 32 has been applied to the silicon nitride layer 12 on the second opposed side of the substrate, and is patterned to correspond to an ink channel, as shown in FIG. 14. The silicon nitride layer 12 is away according to the photoresist pattern. In FIG. 15, an ink channel 34 has been etched into silicon substrate 10 such as by means of deep reactive ion etching. The silicon nitride layer 12 acts as an etch-stop for the deep reactive ion etching. The deep reactive ion etching is stopped after the ink channel is etched sufficiently deep to open up the nozzle opening holes 28.

Figure 16:
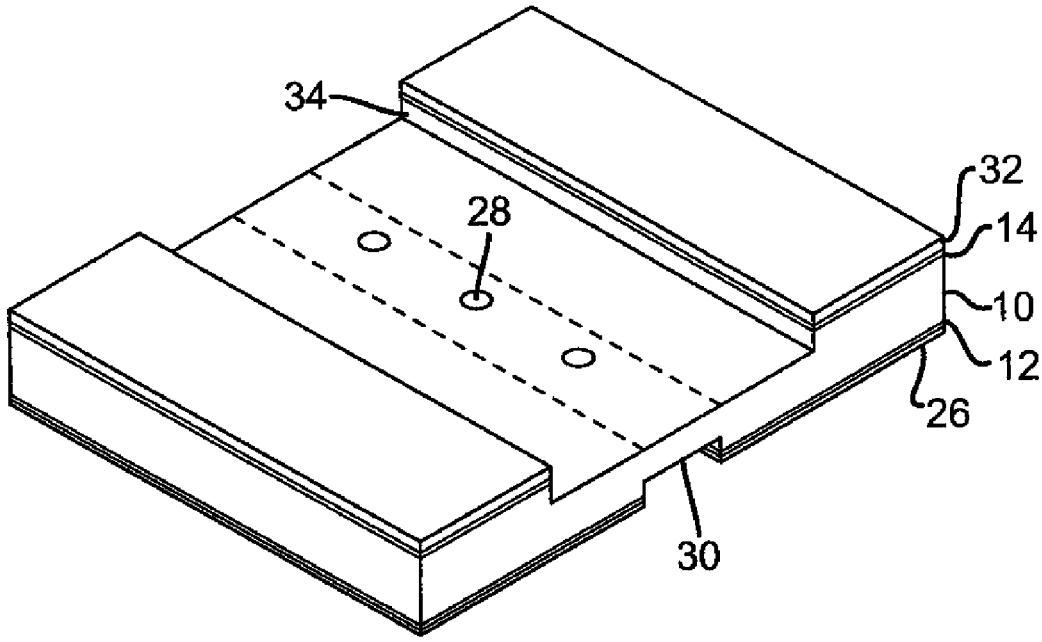
FIG. 16 is a perspective view of the orifice plate at the completion of FIG. 15 in the fabrication process.
Figure 17:
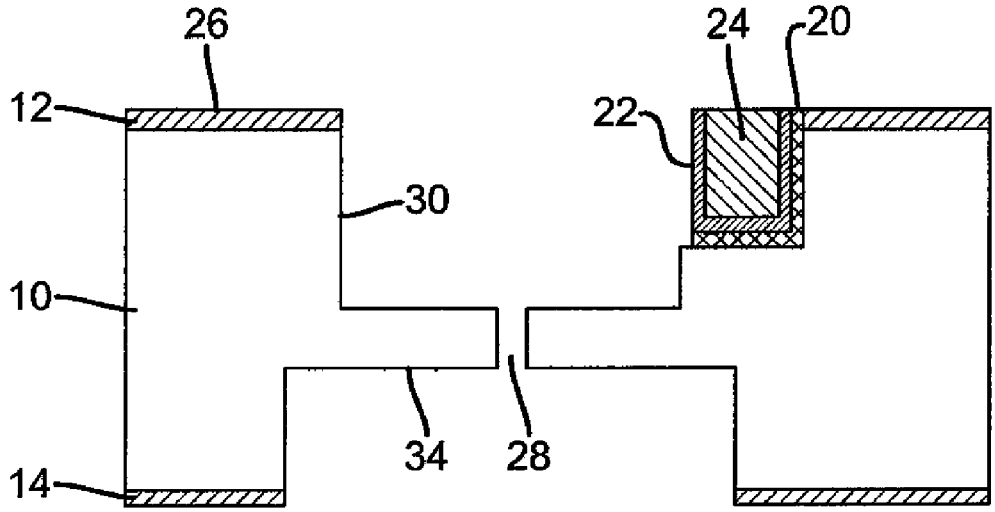
FIG. 17 is a cross-sectional view of a step in a process for fabricating an integrated orifice plate and charge plate according to the present invention.
Figure 18:
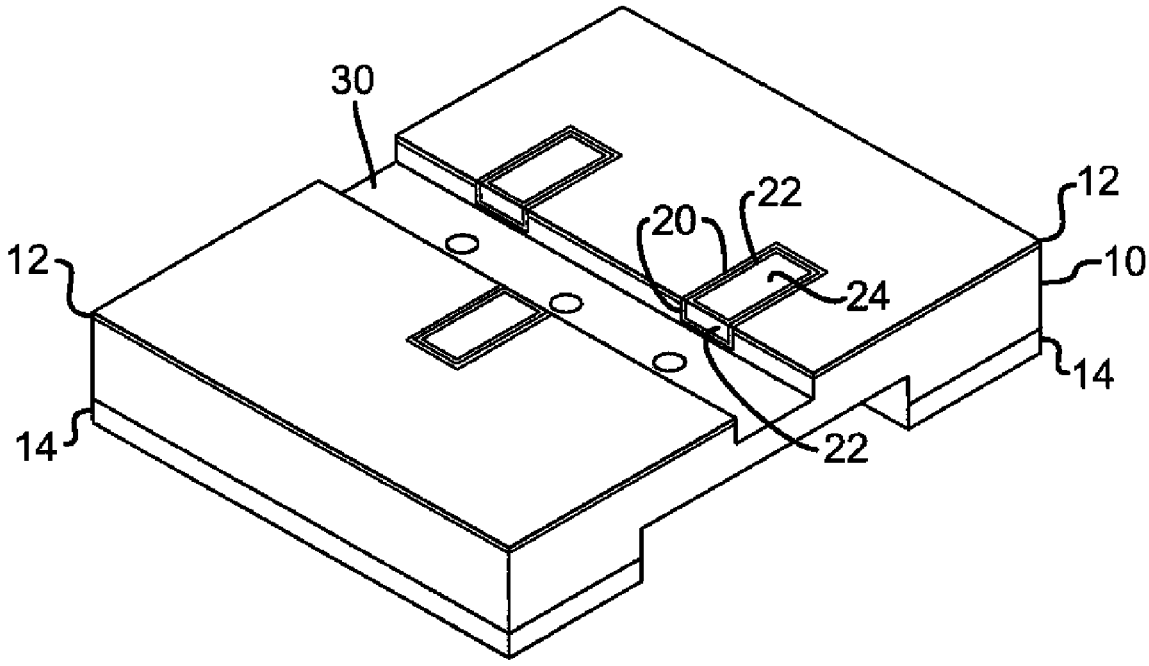
FIG. 18 is a perspective view of the completed integral charge plate and orifice plate according to the present invention.

FIG. 16 illustrates the process at this juncture of the fabrication procedure. Photoresist 32 is stripped using, say, acetone and the wafer surface is $O_2$ plasma cleaned. FIGS. 17 and 18 illustrate the completed electroformed metallic charge plate with orifice plate. For simplicity the figures have shown a very limited number of orifices and their corresponding charging electrodes, it must be understood that typically the structure can have in excess of 10 orifices per millimeter and can have array lengths in excess of 100 millimeters. It also must be understood that a plurality of completed electroformed metallic charge plate with orifice plate units can be fabricated on and diced from a single silicon wafer.

The silicon nitride 14 covered face of this structure can then be attached to a drop generator body. When pressurized with ink, ink is jetted from the nozzle opening holes 28, passing from the ink channel 34 side to the trench 30 side. When the ink is appropriately stimulated to produce stable drop formation, the ink streams, the drop breakoff point should be located in front of the sacrificial material 24 filled charging electrodes.

By means of appropriately designed photomasks and mask aligners, the desired placement of the orifices relative to the charging electrodes can be readily achieved. Since multiple completed electroformed metallic charge plate with orifice plate units are fabricated concurrently without the need to individually align the charge plate and the orifices considerable savings in fabrication cost are possible., The invention has been described in detail with particular reference to certain preferred embodiments thereof, but it will be understood that variations and modifications can be effected within the spirit and scope of the invention.

PARTS LIST

10. silicon substrate
12. silicon nitride layer (etch-stop)
14. silicon nitride layer (etch-stop)
16. photoresist
18. charging channels
20. passivation layer
22. metal (electrical leads) layer
24. sacrificial material
26. photoresist
28. nozzle opening hole
30. trench
32. photoresist layer
34. ink channel

The invention claimed is:

1. A method for integrally fabricating a combined orifice array plate, having an array of orifices from which fluid is jetted to break off as drops, and change plate, having chagrining electrodes for selectively charging the drops as they break off from the fluid jetted from the orifices, for a continuous ink jet printer print head, said method comprising steps of:

providing a silicon substrate having first and second opposed sides;

applying a first etch-stop layer to said first side of the substrate;

etching an array of charging channels into the substrate through the first etch-stop layer on the first side of the substrate;

passivating the array of charging channels by depositing a dielectric insulator into the array of charging channels;

forming charge electrodes by coating the passivated array of charging channels with metal;

applying a second etch-stop layer to said second opposed side of the substrate;

forming the array of orifices; and etching a trench in said first side of the substrate while continuing to etch the array of orifices to a depth such that the charging electrodes are approximately positioned to enable the charging electrodes to selectively charge the drops that break off from the fluid jetted from the orifices.

2. The method for fabricating the combined orifice array plate and charge plate as set forth in claim 1, wherein at least one of the first and second etch-stop layers comprises a layer of silicon nitride.

3. The method for fabricating the combined orifice array plate and charge plate as set forth in claim 1 further comprising a step of forming an ink channel on the second opposed side of the substrate.

4. The method for fabricating the combined orifice array plate and charge plate as set forth in claim 3, wherein the ink channel is formed by:

coating the second opposed side of the substrate with a silicon nitride layer; and etching into the orifice plate substrate through an opening in the silicon nitride layer on the second opposed side of the substrate.

5. The method for fabricating the combined orifice array plate and charge plate as set forth in claim 4, wherein etching into the substrate to form the ink channel is effected by deep reactive ion etching.

6. The method for fabricating the combined orifice array plate and charge plate as set forth in claim 1 wherein at least one of the first etch-stop layer and second etch-stop layer is applied by sputtering.

7. The method for fabricating the combined orifice array plate and charge plate as set forth in claim 1 wherein the charging electrodes are placed alternatively on two sides of the array of orifices.

8. The method for fabricating the combined orifice array plate and charge plate as set forth in claim 1 wherein the etching steps of etching the array of charging channels and etching the trench are effected by wet etching.

9. The method for fabricating the combined orifice array plate and charge plate as set forth in claim 1, wherein:

applying the first and second etch-stop layers includes initially coating the first and second opposed sides of the substrate with a silicon nitride layer; and forming the array of orifices includes etching into the substrate through openings in the silicon nitride layer on the first side of the substrate.

10. The method for fabricating the combined orifice array plate and charge plate as set forth in claim 1, wherein:

applying the first and second etch-stop layers includes initially coating the first and second opposed sides of the substrate with a silicon nitride layer; and forming the array of orifices in the trench includes etching into the substrate through openings in the silicon nitride layer on the first side of the substrate.

* * * * *

UNITED STATES PATENT AND TRADEMARK OFFICE

CERTIFICATE OF CORRECTION

PATENT NO. : 7,437,820 B2
APPLICATION NO. : 11/382773
DATED : October 21, 2008
INVENTOR(S) : Richard W. Sexton et al.

It is certified that error appears in the above-identified patent and that said Letters Patent is hereby corrected as shown below:

| | |
|---|---|
| Column 3, lines 26-27 | delete "chagrining" and insert -- charging --, therefor. |

Signed and Sealed this

Twentieth Day of April, 2010

David J. Kappos

David J. Kappos
*Director of the United States Patent and Trademark Office*